US007255303B2

(12) United States Patent
Jenrick

(10) Patent No.: US 7,255,303 B2
(45) Date of Patent: Aug. 14, 2007

(54) PAPER GUIDE APPARATUS AND METHOD WITH CURL CONTROL

(75) Inventor: Paul W. Jenrick, Schaumburg, IL (US)

(73) Assignee: General Signal Technology Corporation, Charlotte, NC (US)

( * ) Notice: Subject to any disclaimer, the term of this patent is extended or adjusted under 35 U.S.C. 154(b) by 343 days.

(21) Appl. No.: 10/923,773

(22) Filed: Aug. 24, 2004

(65) Prior Publication Data

US 2006/0043230 A1 Mar. 2, 2006

(51) Int. Cl.
*B65H 23/04* (2006.01)

(52) U.S. Cl. ..... 242/615.3; 242/548; 242/566; 271/209

(58) Field of Classification Search ..... 242/615.3, 242/566, 548, 615.21; 346/146; 206/409; 271/188, 209
See application file for complete search history.

(56) References Cited

U.S. PATENT DOCUMENTS 3,216,064 A * 11/1965 Kates, Jr. ..... 19/243
3,658,323 A * 4/1972 Matwey ..... 271/209
3,793,950 A * 2/1974 Kaneko et al. ..... 101/142
5,881,966 A * 3/1999 Ishida ..... 242/566
6,070,828 A * 6/2000 Ishida ..... 242/566
6,231,043 B1 * 5/2001 James et al. ..... 271/209

FOREIGN PATENT DOCUMENTS

JP 59198252 A * 11/1984
JP 62201768 A * 9/1987
JP 02233455 A * 9/1990
JP 03138260 A * 6/1991

* cited by examiner

*Primary Examiner*—Gene O. Crawford
*Assistant Examiner*—Sang Kim
(74) *Attorney, Agent, or Firm*—Baker & Hostetler LLP

(57) ABSTRACT

A paper guide for mounting in front of a paper dispensing slot, has a top wall angled downward with respect to the paper ejection direction by an angle alpha, a pair of opposed side walls at the sides of the top wall, angled inwardly relative to the side edges of the paper by the an angle beta, and also angled inwardly with respect to a line perpendicular to the rear edge of the top wall by an angled gamma, and a pair of mounting tabs, each respective mounting tab extending from a respective side wall for attachment against the paper dispensing device.

20 Claims, 4 Drawing Sheets

PAPER GUIDE APPARATUS AND METHOD WITH CURL CONTROL

FIELD OF THE INVENTION

The invention pertains to the field of dispensing paper from a roll. More particularly, the invention relates to the field of dispensing paper from the roll through an outlet dispensing slot so that it can be removed by a user.

BACKGROUND OF THE INVENTION

Paper dispensers are in wide use in the industry. One example of such use is the dispensing of tickets, which may be for example receipts for a purchase from a vending machine or tickets that are used to gain access to an event or to a transportation system. In some instances, it is known to dispense individual tickets using a system that has a roll of paper and feeds the paper from the roll past a printing element and past a dispensing slot or an outlet of some sort of cutting element so that the amount of paper sticking out of the slot or outlet is available to the user so the user, and can grab the extended paper with his or her hand and remove it.

In some instances, the piece of paper from the roll that is extending out of the dispenser slot will be cut by an automatic blade arrangement that is between the feed rollers and the dispensing slot, and some form of frictional resistance such as an additional set of rollers will provide a small amount of friction to hold the paper in place extending out of the slot until the frictional resistance is overcome by the user pulling the paper out of the slot. In other known devices, the piece of paper extending out of the slot will still be attached to the roll and some form of manual cutter such as a serrated blade edge is present near the slot and when the user removes the piece of paper, the user is pulling the paper against the serrated blade which will tear off the paper at the blade location.

Various types of roll paper are in use in such known commercial paper ticket dispensers. The paper may be plain paper which is printed on by inks by a dot matrix or ink jet printer, or in some instances may be thermal paper which is printed on by a heat-applying print head.

A disadvantage of the above described systems is that in either instance, the paper often tends to curl up as it extends out to the dispensing slot. The paper curl problem can usually to be due to one or more of several factors. First, the paper is initially being dispensed from a roll, and hence tends to have some degree of curl present from the time spent on the roll. This curl problem tends to be most severe with paper towards the end of the roll, which is mst tightly wound around the core. Further, the pressure or heat applied by the print head onto one side of the paper while not on the other side of the paper can also tend to cause the paper to curl, and in many instances, both of these curling effects operate in the same direction on the paper thus reinforcing the curl.

As a result of these curling tendencies, paper which is simply ejected through a rectangular slot will often tend to curl back towards the slot to some degree. This can be undesirable for several reasons. Severe roll-curling can cause the paper to miss the dispensing slot. In some examples, this level of problem can begin to occur when the roll is used down to ⅓ of its diameter. Also, when the user removes the piece of paper, the user is left with a curled piece, which may be asthetically unappealing and also not convenient to carry in a pocket or fold. Further, the curled paper may tend to curl vertically upwards for example and hug the front housing of the dispensing device, making it somewhat more difficult to grasp for removal than if it were sticking roughly straight out from the dispensing device. Finally, the curled paper while curled in one direction is substantially flat in the other direction. As a result, the paper may be susceptible to flopping in the wind, or in the case of strong winds even being blown out of the dispenser before the user has a chance to remove it.

The curling problem can also be more severe in the case of thermal printed paper. The coated side of the paper may tend to curl when printed, further reinforcing the curl.

Accordingly, there is a need in the art for a paper guide that can overcome the above curled paper disadvantages at least to some extent.

SUMMARY OF THE INVENTION

The foregoing needs are met, to a great extent, by the present invention, wherein in one aspect an apparatus is provided that in some embodiments a paper guide for mounting in front of a paper dispensing slot of a paper dispensing device that dispenses paper in a paper ejection direction, the guide comprising a top wall angled downward with respect to the paper ejection direction by an angle $\alpha$, a pair of opposed side walls at the sides of the top wall, angled inwardly relative to the side edges of the paper by the an angle $\beta$, and also angled inwardly with respect to a line perpendicular to the rear edge of the top wall by an angle $\gamma$, and a pair of mounting tabs, each respective mounting tab extending from a respective side wall for attachment against the paper dispensing device.

In accordance with one embodiment of the present invention, a paper guide for mounting in front of a paper dispensing slot of a paper dispensing device that dispenses paper in a paper ejection direction, the guide comprising a top paper guiding means angled downward with respect to the paper ejection direction by an angle $\alpha$, a pair of opposed side walls at the sides of the top wall, angled inwardly relative to the side edges of the paper by the an angle $\beta$, and also angled inwardly with respect to a line perpendicular to the rear edge of the top wall by an angle $\gamma$, and mounting means for mounting the guide against the paper dispensing device.

In accordance with another embodiment of the present invention a method for dispensing paper in a paper dispensing direction from a paper dispensing device, comprising feeding paper through a dispensing slot, and guiding the paper via a paper guide having, a top wall angled downward with respect to the paper ejection direction by an angle $\alpha$, a pair of opposed side walls at the sides of the top wall, angled inwardly relative to the side edges of the paper by the an angle $\beta$, and also angled inwardly with respect to a line perpendicular to the rear edge of the top wall by an angle $\gamma$, and a pair of mounting tabs, each respective mounting tab extending from a respective side wall for attachment against the paper dispensing device.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
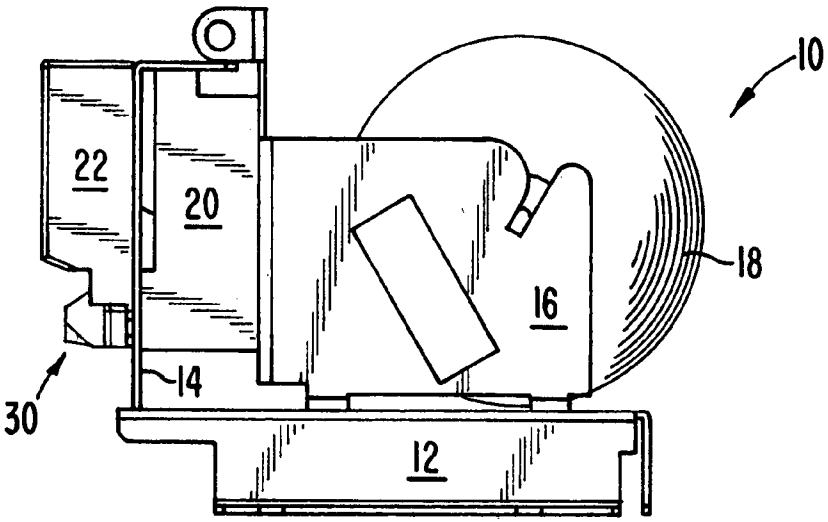
FIG. 1 is a side layout view of a paper dispensing apparatus having a paper guide according to a preferred embodiment of the present invention.
Figure 2:
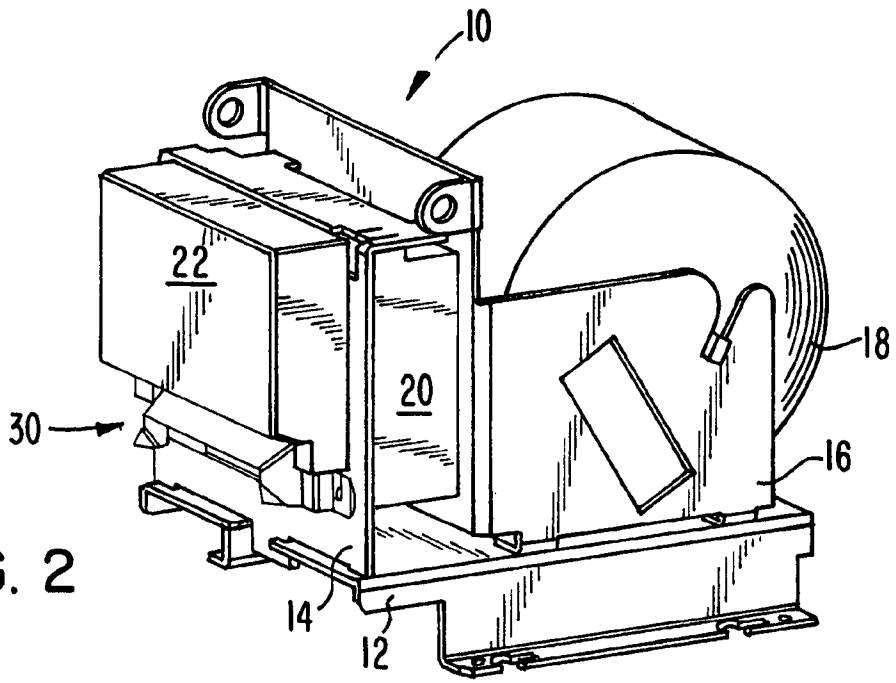
FIG. 2 is a perspective view of the apparatus of FIG. 1.

Preferred embodiments of the invention will now be described with reference to the drawing figures, in which like reference numerals refer to like parts throughout. FIGS. 1 and 2 illustrate a paper dispensing apparatus 10 which has a base or frame 12 supporting a paper holder 16. The paper holder 16 supports a roll of paper 18. The frame 12 also supports a front mounting plate 14 which supports paper processing items 20 and 22. Item 20 may be for example, a printing device which may print onto thermal heat head, or may print onto conventional paper using a dot matrix and a ribbon or an ink jet print head. Item 22 may for example be a paper cutter which cuts off the paper after a certain amount has been dispensed through an outlet slot, but also has a frictional retaining means to retain the cut piece of paper until it is removed by the user. One or both of items 20 and 22 may include paper feeding rollers.

A paper outlet slot (not visible) is located just behind a paper guide 30. The paper guide 30 is mounted just in front of, i.e., outside of, the paper ejection slot. In the illustrated example, the printing assembly 20 is a thermal printer mounted to the rear of the front mounting plate 14. The paper is ejected from the printer 20 through a slot in the mounting plate 14. An automatic cutter 22 is mounted to the front of the mounting plate 14 and cuts off the paper. The printing assembly 20 and cutting assembly 22 may each have appropriate feeding rollers which grasp the paper from the top and/or the bottom and feed the paper forward and out through the slot including during the printing process. In some instances, an automatic cutter blade may not be provided, and instead a static cutter blade may be provided near the slot so that as the user pulls on the rejected paper, the paper is cut or torn by the force provided by the user at a location near the slot.

Figure 9:
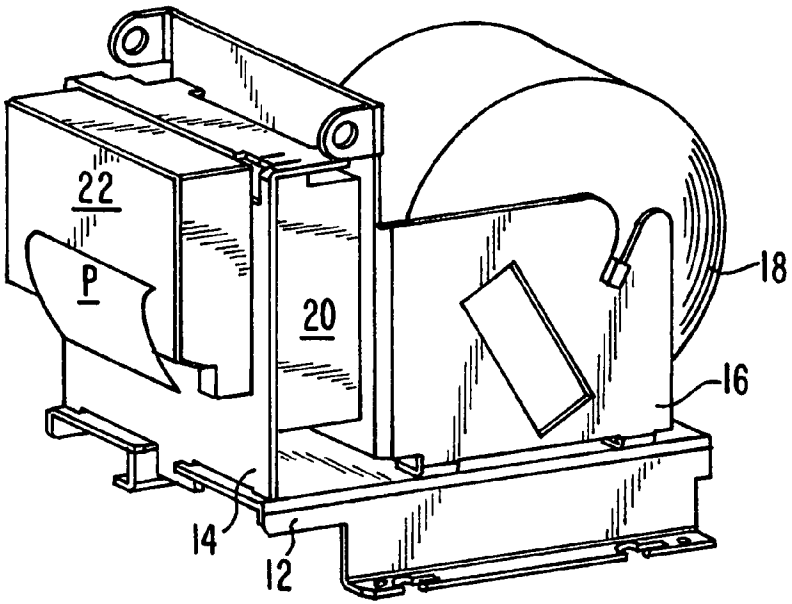
FIG. 9 is a perspective view of the paper dispensing apparatus dispensing paper with the paper guide omitted as in FIG. 8.
Figure 8:
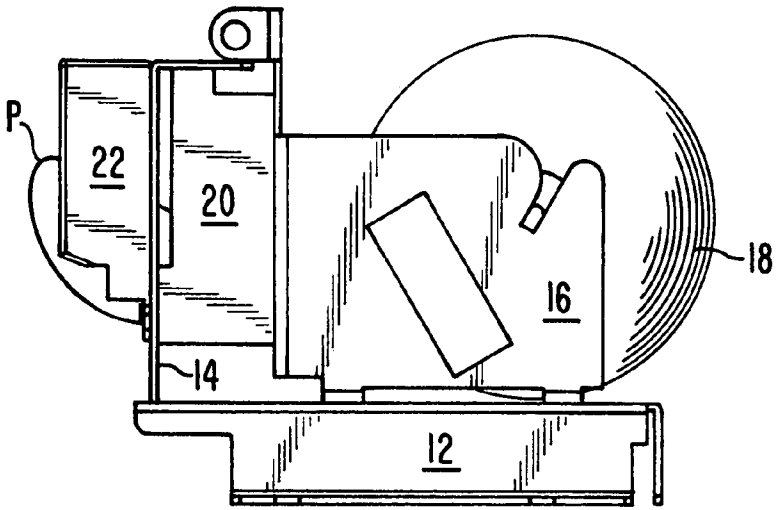
FIG. 8 is a side layout view of a paper dispensing apparatus dispensing paper with the paper guide omitted.

The paper guide 30 provides a significant advantage of the invention by reducing curl of the ejected paper that could otherwise occur. For example, FIGS. 8 and 9 show a ticket dispensing assembly similar to that of FIGS. 1 and 2 but with the paper guide 30 omitted. FIGS. 8 and 9 illustrate the problem that can occur with a slot dispenser that does not have a paper guide, because the paper P tends to curl upwards as shown. The situation shown in FIGS. 8 and 9 can be undesirable for many reasons, including the paper being hard to grasp for removal, the paper being curled even after removal, and/or the paper having a tendency to flap in the wind or be blown from the slot.

The paper guide 30 can overcome these problems at least to a great extent. Turning to FIGS. 3-6, it will be appreciated that the paper guide 30 has a top wall 32, which has a rear edge 34 and a front edge 36, and two side walls 40 each having a respective ear 42. Respective side tabs 50 each have a front portion 52 and an intermediate portion 54 and a rear portion 56 which is adapted to be mounted against the front mounting plate 14 of the paper dispensing assembly. An immediate portion 54 offsets the rear edge 34 from the plane of the mounting tabs 56 to provide a clearance for a cutting arrangement which is the lower part of the cutting assembly 22. The mounting tabs 50 provide the mounting of the paper guide so it is in front of the outlet slot through which the piece of paper is ejected.

Figure 4:
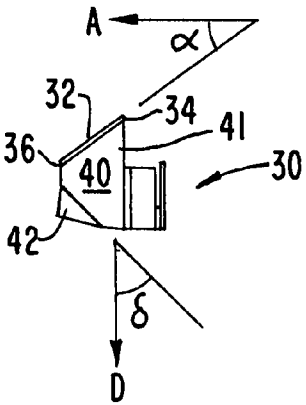
FIG. 4 is a side view of the paper guide.

Referring now to FIG. 4, it can be seen that the top wall 32 is at an angle $\alpha$ to the illustrated direction A. Direction A is a direction which is substantially the direction of ejection of the paper through the slot and is also a direction substantially perpendicular to edge 41 which is the rear edge of the sidewall 40. Typically, direction A will be a horizontal direction and rear edge 41 will be oriented in a vertical direction D which is parallel to the plane in which the front mounting plate 14 extends.

Figure 5:
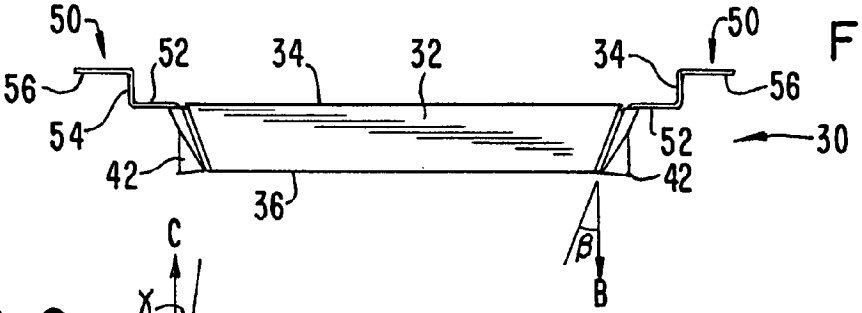
FIG. 5 is a top view of the paper guide.

Turning to FIG. 5, the side walls 40 are each angled by a angle $\beta$ relative to direction B, which B is perpendicular to the rear edge 34 of the top wall 32, and is also referred to as to the forward paper rejection direction.

Figure 6:
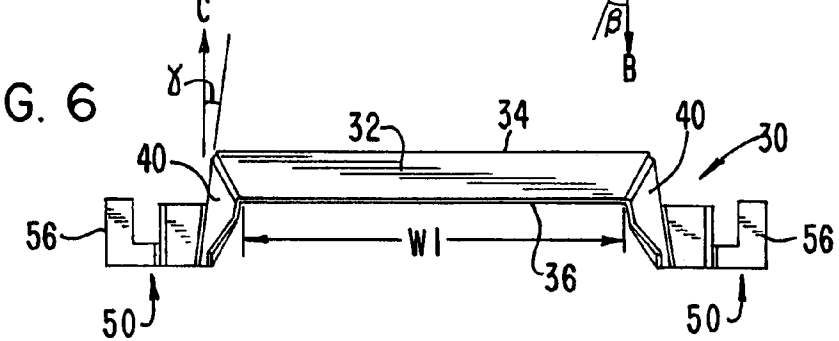
FIG. 6 is a front view of the paper guide.

Turning to FIG. 6, the side walls 40 are also angled by angle $\gamma$ relative to direction C which is a direction perpendicular to the rear edge 34 and parallel to the rear edge 41, and which typically will be an upward direction that is perpendicular to the direction of ejection of the paper, roughly parallel to the direction of the mounting plate 14. Referenced directions A, B, and C are each perpendicular to each other and that form a coordinate axis set.

Figure 3:
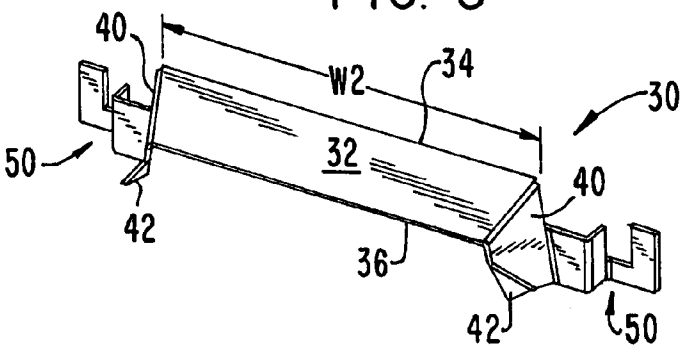
FIG. 3 is a perspective view of a paper guide used in the apparatus of FIG. 1.

Turning to FIGS. 3 and 6 in particular, it can be seen that the rear edge 34 of the top wall 32 has a width W2 and the front edge 36 has a width W1. Thus, the overall paper guide defined by top wall 32 and side walls 40 can be said to be tapering both in a downward direction and in a converging direction as the paper is ejected along it. Edge 42 is far out at the front and lower corners of the side walls 40 to provide a somewhat smooth corner, as opposed to a rough edge for supporting the sides of the ejected paper, as discussed in more detail below.

Figure 7:
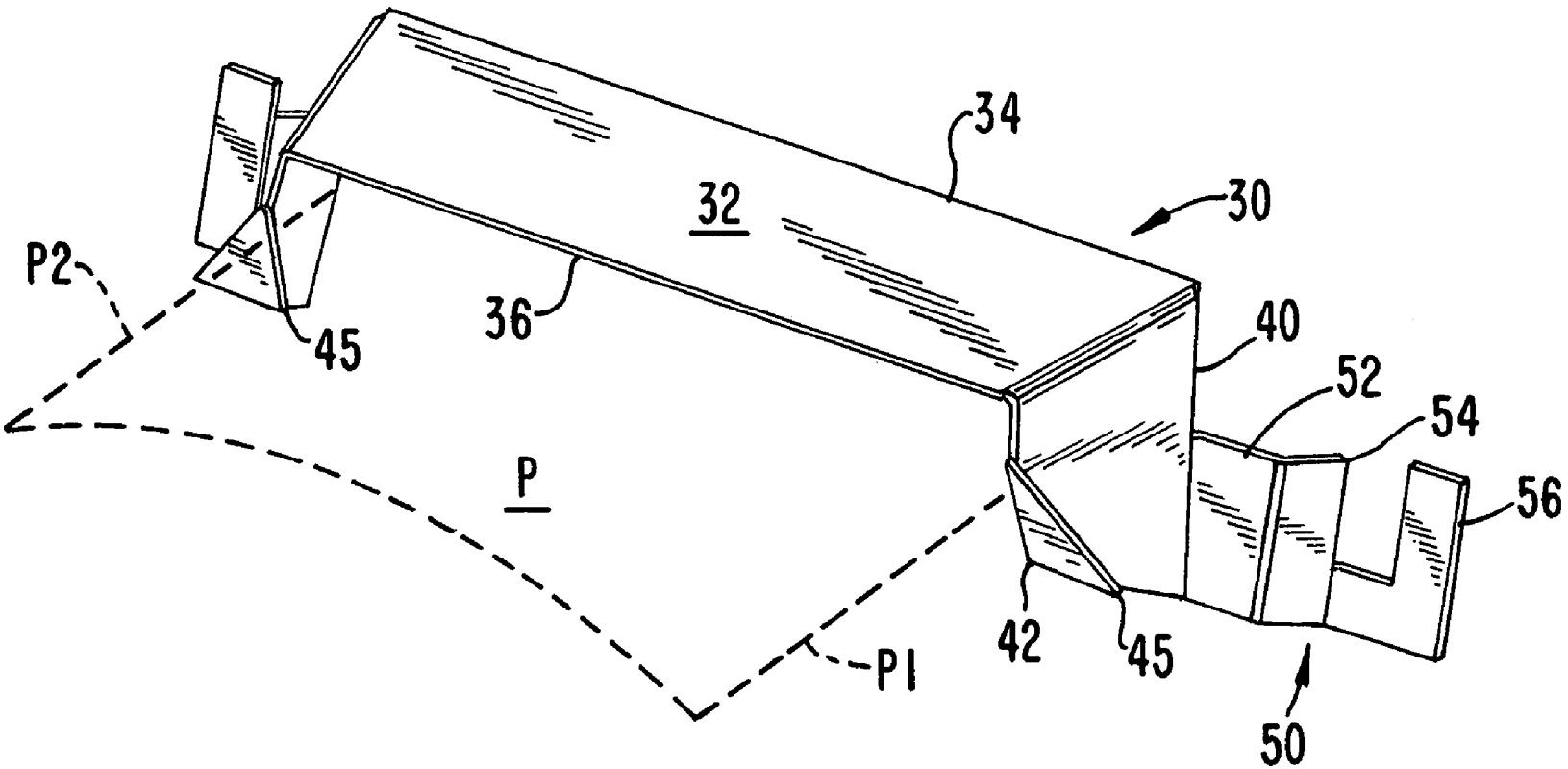
FIG. 7 is a perspective view of the paper guide showing a piece of dispensed paper.

FIG. 7 illustrates the paper being bent somewhat downwardly in an arc so that its edges P1 and P2 are each in contact with a corner 45 which is formed at the junction of the side wall 40 and the ear 42. In an alternative embodiment, the ears 42 can be omitted, and in such an embodiment the location of the bend 45 would simply be an open edge. Such an embodiment would function substantially similarly, that the provision of the ears 42 provides for the bend 45 to be a relatively smooth metal surface rather, than a relatively sharp edge, and thus presents less resistance to the paper sliding out of the guide. The ear 42 meets the side wall 40 at an angle δ relative to reference line B as shown in FIG. 4, where D is again the vertical line associated with the rear wall 41 and the front mounting plate 14.

In one preferred embodiment, the paper width is 2.281 inches, the width W1 is 2.214 inches and the width W2 is 2.50 inches. In this preferred embodiment, the angle α is 30 degrees, the angle β is 20 degrees and the angle γ is β degrees, and the angle δ is 45 degrees.

Turning now to FIG. 7, the operation of the paper guide 30 is shown wherein a sample piece of paper P is shown extending from the paper guide 30. It can be seen that rather than curling upwards as in FIGS. 8 and 9, in FIG. 7 the paper in general extends straight outwards, while having a very slight curve from side to side, as opposed to end to end. The imparting of this side to side curve is significant enough to resist upward or downward curling and also may in some circumstances impart a very small stress bend to the paper which causes it to resist curling in the end to end direction even after it is removed to some extent. The ears 42 bend away from the wall 40 at a 40 to 30 degree angle measured directly between their respective planes with an angle δ of 45 degrees. Therefore, the ear 42, in addition to providing a smooth edge as described above also provides (1) a stronger degree of side to side curvature when the paper is near the end of the roll (i.e. when it tends to inherently have more upward end to end curl) and (2) a lesser amount of side to side curvature when the paper is at the beginning of the roll. Thus, as the curl becomes more severe at the smaller radiis of paper, the paper is forced up and in contact with edge 36 at which location the strongest side to side curve is imparted.

In the illustrated example, the printer 22 is thermal printer and the paper is coated thermal paper, which the printer 22 prints on by making dots with discharge arcs. The guide 30 also resists curl that is imparted by the printing process.

It will be appreciated that the result obtained in FIG. 7 makes the paper easier to grasp since substantially all of its length is extending directly outward from the dispensing slot. The result also makes the paper more resistant to being blown by the wind, since it is supported not only behind the dispensing slot, but also by its contact with the side walls 40 outside the dispensing slot, but also by its contact with the side walls 40 outside the dispensing slot. The result of FIG. 7 may in turn also result in some instances in a paper with less permanent curl even after it is removed.

Another advantage of the paper guide 30, is that it is readily manufactured from a single piece of sheet metal by cutting an appropriate blank sheet and then folding it. In additional to reducing paper curl, the paper guide also serves to some extent as a roof or hood over the paper dispensing slot, and thus can also have the benefit of protecting the slot at least to some extent from the elements including rain or settling dust.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A paper guide for mounting in front of a paper dispensing slot of a paper dispensing device that dispenses paper in a paper ejection direction, the guide comprising:

a top wall angled downward with respect to the paper ejection direction by an angle α;

a pair of opposed side walls at the sides of the top wall, angled inwardly relative to the side edges of the paper by an angle β, and also angled inwardly with respect to a line perpendicular to the rear edge of the top wall by an angle γ; and a pair of mounting tabs, each respective mounting tab extending from a respective side wall for attachment against the paper dispensing device so that paper is dispensed between the side walls and under the top wall.

2. The guide of claim 1, wherein the angle α is 30 degrees.

3. The guide of claim 1, wherein the angle β is 20 degrees.

4. The guide of claim 1, wherein the angle γ is 8 degrees.

5. The guide of claim 1, wherein the top wall has a rear edge having a rear edge width greater than the width of the dispensed paper, and a front edge having a front edge width less than the width of the paper.

6. The guide of claim 1, wherein the side walls each have a respective rear edge defining a side wall rear edge spacing between the side walls which is greater than the width of the dispensed paper.

7. A paper guide for mounting in front of a paper dispensing slot of a paper dispensing device that dispenses paper in a paper ejection direction, the guide comprising:

a top wall angled downward with respect to the paper ejection direction by an angle α;

a pair of opposed side walls at the sides of the top wall, angled inwardly relative to the side edges of the paper by an angle β, and also angled inwardly with respect to a line perpendicular to the rear edge of the top wall by an angle γ;

a pair of mounting tabs, each respective mounting tab extending from a respective side wall for attachment against the paper dispensing device; and a pair of ears, wherein each respective ear extends from a forward part of a respective side wall, at an angle δ to the respective side wall.

8. A paper guide for mounting in front of a paper dispensing slot of a paper dispensing device that dispenses paper in a paper ejection direction, the guide comprising:

a top paper guiding means angled downward with respect to the paper ejection direction by an angle α;

a pair of opposed side walls at the sides of the top wall, angled inwardly relative to the side edges of the paper by an angle β, and also angled inwardly with respect to a line perpendicular to a rear edge of the top wall by an angle γ; and mounting means for mounting the guide against the paper dispensing device so that paper is dispensed between the side walls and under the top wall.

9. The guide of claim 8, wherein the angle α is 30 degrees.

10. The guide of claim 8, wherein the angle β is 20 degrees.

11. The guide of claim 8, wherein the angle γ is 8 degrees.

12. The guide of claim 8, wherein the top paper guiding means has a rear edge having a rear edge width greater than the width of the dispensed paper, and a front edge having a front edge width less than the width of the paper.

13. The guide of claim 8, wherein the side walls each have a respective rear edge defining a side wall rear edge spacing between the side walls which is greater than the width of the dispensed paper.

14. A paper guide for mounting in front of a paper dispensing slot of a paper dispensing device that dispenses paper in a paper ejection direction, the guide comprising:

a top paper guiding means angled downward with respect to the paper ejection direction by an angle $\alpha$;

a pair of opposed side walls at the sides of the top wall, angled inwardly relative to the side edges of the paper by an angle $\beta$, and also angled inwardly with respect to a line perpendicular to a rear edge of the top wall by an angle $\gamma$;

mounting means for mounting the guide against the paper dispensing device; and a pair of ears, wherein each respective ear extends from a forward part of a respective side wall, at an angle $\delta$ to the respective side wall.

15. A method for dispensing paper in a paper dispensing direction from a paper dispensing device, comprising:

feeding paper through a dispensing slot; and guiding the paper via a paper guide having;

a top wall angled downward with respect to the paper ejection direction by an angle $\alpha$;

a pair of opposed side walls at the sides of the top wall, angled inwardly relative to the side edges of the paper by an angle $\beta$, and also angled inwardly with respect to a line perpendicular to the rear edge of the top wall by an angle $\gamma$; and a pair of mounting tabs, each respective mounting tab extending from a respective side wall for attachment against the paper dispensing device so that paper is dispensed between the side walls and under the top wall.

16. A method for dispensing paper in a paper dispensing direction from a paper dispensing device, comprising:

feeding paper through a dispensing slot; and guiding the paper via a paper guide having;

a top wall angled downward with respect to the paper ejection direction by an angle $\alpha$;

a pair of opposed side walls at the sides of the top wall, angled inwardly relative to the side edges of the paper by an angle $\beta$, and also angled inwardly with respect to a line perpendicular to the rear edge of the top wall by an angle $\gamma$; and a pair of mounting tabs, each respective mounting tab extending from a respective side wall for attachment against the paper dispensing device, wherein the guide further comprises a pair of ears, wherein each respective ear extends from a forward part of a respective side wall, at an angle $\delta$ to the respective side wall.

17. The method of claim 15, wherein the angle $\alpha$ is 30 degrees.

18. The method of claim 15, wherein the angle $\beta$ is 20 degrees.

19. The method of claim 15, wherein the angle $\gamma$ is 8 degrees.

20. The method of claim 15, wherein the top wall has a rear edge having a rear edge width greater than the width of the dispensed paper, and a front edge having a front edge width less than the width of the paper.

* * * * *